US005536143A

United States Patent [19]

Jacala et al.

[11] Patent Number: 5,536,143

[45] Date of Patent: Jul. 16, 1996

[54] CLOSED CIRCUIT STEAM COOLED BUCKET

[75] Inventors: Ariel Jacala; Richard M. Davis, both of Scotia, N.Y.; Michael A. Sullivan, Inman, S.C.; R. Paul Chiu, Scotia; Fred Staub, Schenectady, both of N.Y.

[73] Assignee: General Electric Co., Schenectady, N.Y.

[21] Appl. No.: 414,700

[22] Filed: Mar. 31, 1995

[51] Int. Cl.[6] ..... F01D 5/18

[52] U.S. Cl. ..... 416/96 R; 416/97 R

[58] Field of Search ..... 415/115, 116, 415/114; 416/96 R, 96 A, 97 R, 97 A, 224; 60/39.53, 39.54, 39.58, 39.75, 39.182

[56] References Cited

U.S. PATENT DOCUMENTS

| | | |
|---|---|---|
| 2,469,678 | 5/1949 | Wyman . |
| 2,647,368 | 8/1953 | Triebbnigg et al. . |
| 2,787,121 | 4/1957 | Bouffart . |
| 2,920,865 | 1/1960 | Lombard . |
| 3,051,439 | 8/1962 | Hilton . |
| 3,275,294 | 9/1966 | Allen et al. . |

(List continued on next page.)

FOREIGN PATENT DOCUMENTS

| | | |
|---|---|---|
| 545792 | 9/1957 | Canada . |
| 2540937 | 8/1984 | France . |
| 59-126034 | 7/1984 | Japan . |
| 0135604 | 7/1985 | Japan ..... 415/115 |
| 60-206905 | 10/1985 | Japan . |
| 3-194101 | 8/1991 | Japan . |
| 774499 | 5/1957 | United Kingdom . |
| 806033 | 12/1958 | United Kingdom . |
| 861632 | 2/1961 | United Kingdom . |
| 880069 | 10/1961 | United Kingdom . |
| 904546 | 8/1962 | United Kingdom . |
| 2236145 | 3/1991 | United Kingdom . |

OTHER PUBLICATIONS

"Development of High–Temperature Turbine Subsystem to a 'Technology Readiness Status' Phase II," Quarterly Report, Oct.–Dec. 1979, Horner, General Electric Company, Feb. 1980, p. 8.

"Closed Circuit Steam Cooling in Gas Turbines", Alderson et al., ASME/IEEE Power Generation Conference, Miami Beach, Florida, Oct. 1987.

"New Advanced Cooling Technology and Material of the 1500° C. Class Gas Turbine", Matsuzaki et al., International Gas Turbine and Aeroengine Congress and Exposition, Cologne, Germany, Jun. 1992.

(List continued on next page.)

*Primary Examiner*—Edward K. Look
*Assistant Examiner*—Christopher Verdier
*Attorney, Agent, or Firm*—Nixon & Vanderhye

[57] ABSTRACT

In a gas turbine bucket having a shank portion, a radial tip portion and an airfoil having leading and trailing edges and pressure and suction surfaces, and an internal fluid cooling circuit, an improvement wherein the internal fluid cooling circuit has a serpentine configuration including plural radial outflow passages and plural radial inflow passages. The radial outflow passages, in one example, are shaped to have aspect ratios of about 3.3 to 1 and Buoyancy Numbers of <0.15 or >0.80. A method of determining a configuration for steam cooling passages for a bucket stage in a gas turbine is also provided which includes, in one example, the steps of:

a) determining combustion gas inlet temperature and mass flow rate of combustion gases passing through the gas turbine stage;

b) taking into account Coriolis and buoyancy secondary flow effects in the steam coolant caused by rotation of the bucket stage; and c) configuring the radial outflow coolant passages to have a size and shape sufficient to produce aspect ratios of about 3.3 to 1 and Buoyancy Numbers in the radial outflow passages of <0.15 or >0.80.

27 Claims, 13 Drawing Sheets

U.S. PATENT DOCUMENTS

| | | | |
|---|---|---|---|
| 3,443,790 | 5/1969 | Buckland . | |
| 3,729,930 | 5/1973 | Williams . | |
| 3,749,514 | 7/1973 | Kelch et al. | 416/96 R |
| 3,785,146 | 1/1974 | Bailey et al. . | |
| 3,807,892 | 4/1974 | Frei et al. | 415/116 |
| 4,073,599 | 2/1978 | Allen et al. . | |
| 4,136,516 | 1/1979 | Corsmeier | 416/96 R |
| 4,302,153 | 11/1981 | Tubbs . | |
| 4,314,442 | 2/1982 | Rice . | |
| 4,338,780 | 7/1982 | Sakamoto et al. . | |
| 4,384,452 | 5/1983 | Rice . | |
| 4,424,668 | 1/1984 | Mukherjee . | |
| 4,462,754 | 7/1984 | Schofield . | |
| 4,507,914 | 4/1985 | Rice | 415/114 |
| 4,545,197 | 10/1985 | Rice . | |
| 4,550,562 | 11/1985 | Rice . | |
| 4,571,935 | 2/1986 | Rice . | |
| 4,807,433 | 2/1989 | Maclin et al. . | |
| 4,835,958 | 6/1989 | Rice . | |
| 4,969,324 | 11/1990 | Woodson . | |
| 4,982,564 | 1/1991 | Hines | 60/39.53 |
| 5,120,192 | 6/1992 | Ohtomo et al. . | |
| 5,160,096 | 11/1992 | Perkins et al. . | |
| 5,177,954 | 1/1993 | Paul . | |
| 5,232,343 | 8/1993 | Butts | 416/97 R |
| 5,350,277 | 9/1994 | Jacala et al. . | |
| 5,391,052 | 2/1995 | Correia et al. . | |
| 5,403,159 | 4/1995 | Green et al. | 416/97 R |
| 5,413,463 | 5/1995 | Chiu et al. . | |

OTHER PUBLICATIONS

"Heat Transfer in Rotating Serpentine Passages with Smooth Walls", Wagner et al., Gas Turbine and Aeroengine Congress and Exposition–Jun., 1990.

"Heat Transfer in Rotating Serpentine Passages with Trips Skewed to the Flow", Johnson et al., International Gas Turbine and Aeroengine Contress and Exposition, Cologne, Germany, Jun., 1992.

"Effect of Uneven Wall Temperature on Local Heat Transfer in a rotating Square Channel With Smooth Walls and Radial Outward Flow", Journal of Heat Transfer, Nov. 192, vol. 114, pp. 850–858.

"Prediction of Turbulent Flow and Heat Transfer in a Radially Rotating Square Duct", Prakash et al., Heat Transfer in Gas Turbine Engines, HTD–vol. 188, ASME 1991.

110
112
114
116
118
120
122
124
126
128
130
132
132

Fig. 10A
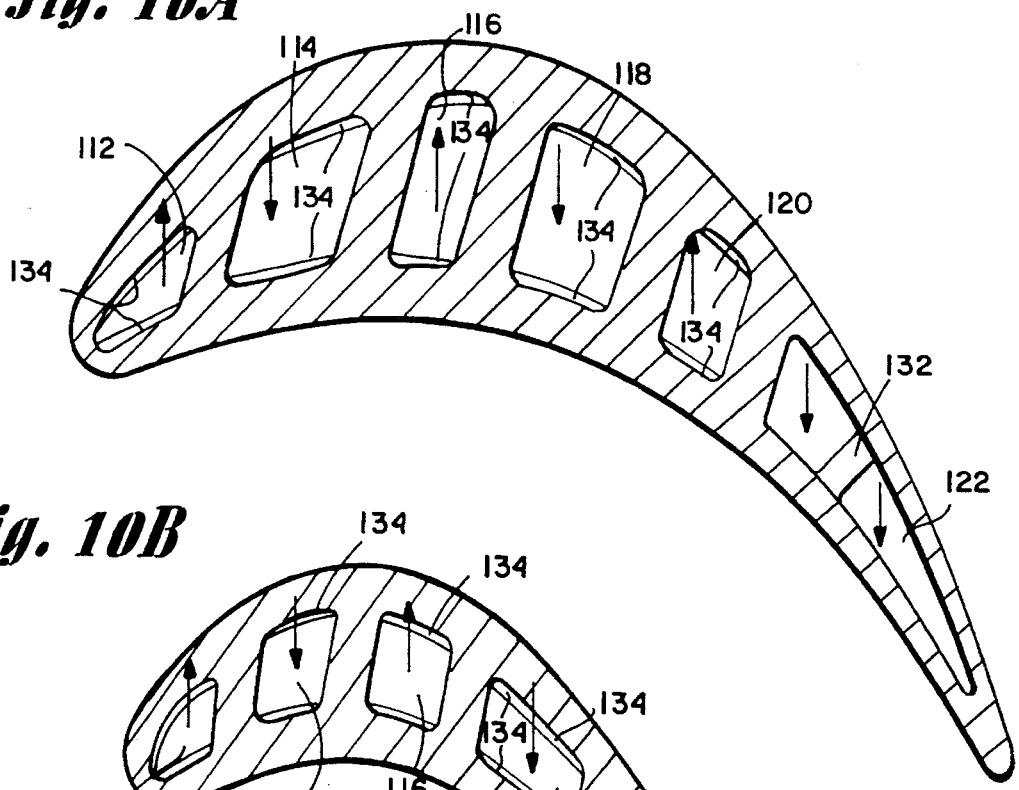
Fig. 10B
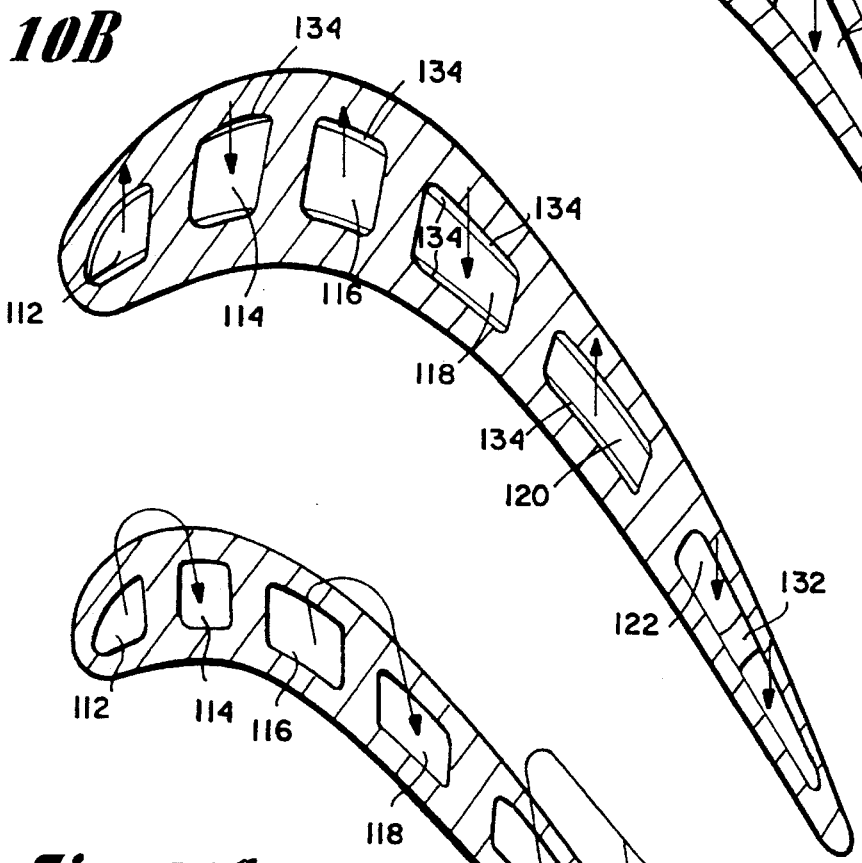
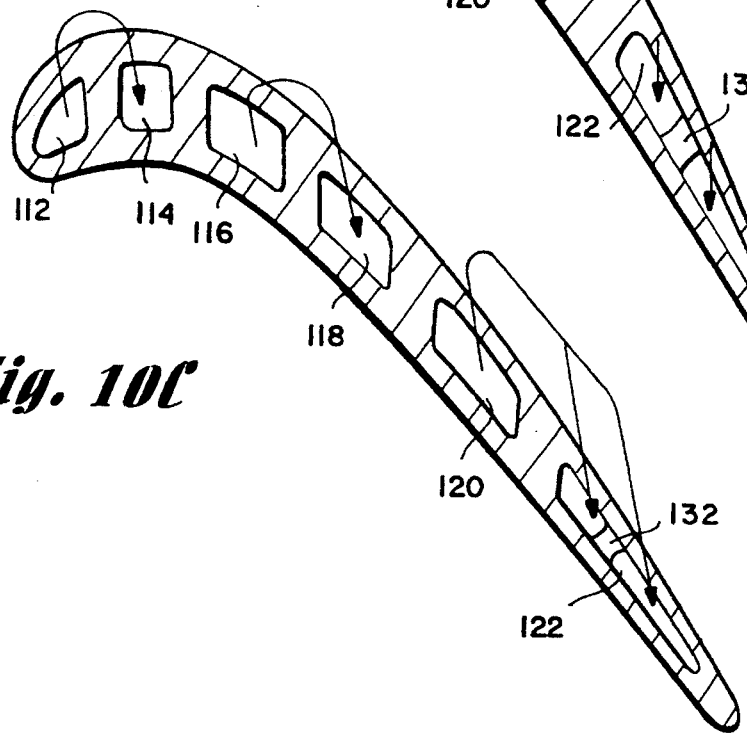
Fig. 10C

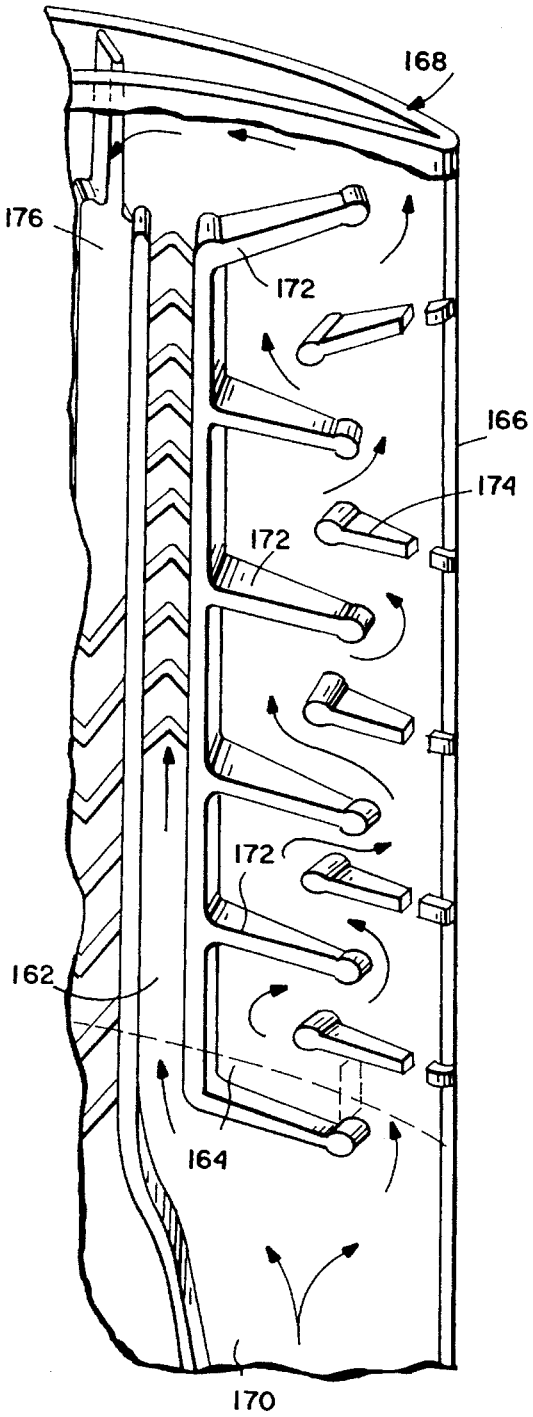
Fig. 15
Fig. 16
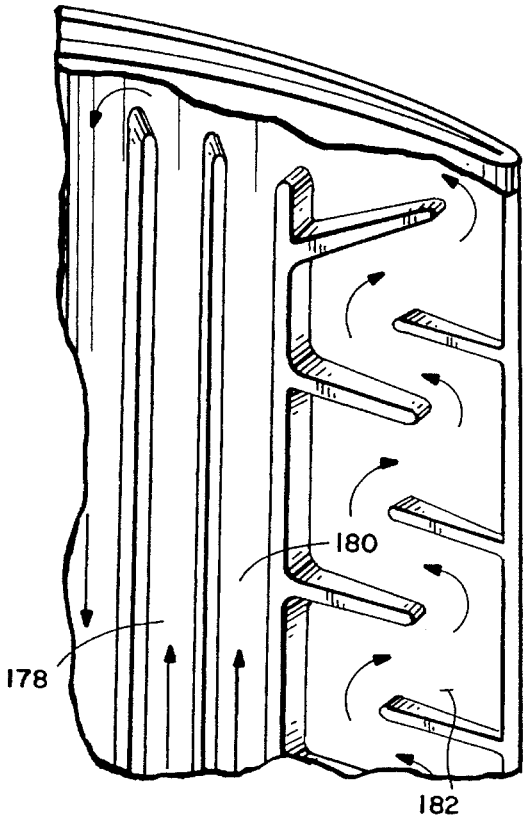

CLOSED CIRCUIT STEAM COOLED BUCKET

TECHNICAL FIELD

This invention relates to a new land based gas turbine in simple or combined cycle configuration, which permits a user to incorporate air or steam cooling of hot gas turbine parts with minimal change in components, and which also incorporates design changes enabling certain turbine components to be used without change in both 50 and 60 Hz turbines. The invention here specifically relates to cooling steam circuits for the gas turbine buckets in the first and second stages of a four stage combined cycle gas turbine.

BACKGROUND

Gas turbine blades have historically used compressor bleed air as the cooling medium to obtain acceptable service temperatures. Cooling passages associated with this design technology are typically serpentine arrangements along the mean camber line of the blades. The camber line is the locus of points between the low pressure and high pressure sides of the airfoil. Adjacent radial passages are connected alternately at the top and bottom by 180 degree return U-bends to form either a single continuous passage, or independent serpentine passages, with the cooling air exiting into the gas path by one or a combination of the following schemes (a) leading edge holes, (b) hole exits along the trailing edge, (c) hole exits on the high pressure side and low pressure sides of the blade airfoil, and (d) tip, cap holes.

Each radial passage typically cools both the high pressure and low pressure sides of the blade airfoil. The specific geometry of each radial cooling passage is designed to balance the conflicting demands for low pressure drop and high heat transfer rate. Schemes used in the state of the art to enhance heat transfer rate include raised rib turbulence promoters (also known as trip strips or turbulators), passage crossover impingement, the use of impingement inserts, and the use of banks or rows of pins. These schemes increase the local turbulence in the flow and thus raise the rate of heat transfer. The effectiveness of open circuit air cooling is further improved by the coverage of the blade airfoil by an insulating film of air bled through openings in the airfoil surface. The disadvantage of using compressor bleed flow, however, is that it is inherently parasitic. In other words, turbine component cooling is achieved at the expense of gas turbine thermodynamic efficiency. Cooling schemes involving high pressure and high density fluids, such as steam, on the other hand, have not yet been employed for blade cooling or reduced to practice in commercially available gas turbines.

DISCLOSURE OF THE INVENTION

The object of this invention is to provide a turbine blade design which can be used to operate under gas turbine conditions with very high external combustion gas temperatures (about 2400° F.) and high internal pressure coolant supply conditions (600–1000 psi) typical of extraction steam available from the steam turbine cycle of a combined cycle steam and gas turbine power plant. Commonly owned co-pending application Ser. No. 08/414,698 entitled "Removable Inner Turbine Shell With Bucket Tip Clearance Control" discloses a removable inner shell which permits easy access and conversion of stage 1 and 2 stator and rotor components from air to steam cooling. Commonly owned co-pending application Ser. No. 08/414,695 entitled "Closed Or Open Circuit Cooling Of Turbine Rotor Components" discloses the manner in which the cooling steam is fed to the stage 1 and 2 buckets. Both applications are incorporated herein by reference.

This invention relates to the stage 1 and 2 turbine blades per se, and seeks to maximize the thermodynamic efficiency of the gas turbine cycle by using steam as the turbine blade coolant instead of air bled from the gas turbine compressor for the first and second stages of the gas turbine, i.e., the stages where cooling is most critical. In reaching the desired goal, the design of closed circuit steam cooled blades and associated coolant passages is determined in accordance with the following additional criteria;

1) minimum coolant pressure loss;

2) predictable and adequate heat transfer;

3) metal temperature consistent with part life objectives;

4) minimization of secondary flow effects; and 5) ease of manufacture.

By way of additional background, the high gas inlet temperatures required to maximize gas turbine thermodynamic efficiency are sufficient to melt metals used in gas turbine blade construction. The blades used in the first few stages are cooled to prevent melting, stress rupture, excessive creep and oxidation. The cooling must be judiciously applied to prevent premature cracking due to low cycle fatigue. The continuing increases in gas turbine inlet temperature, and the use of combined cycles to maximize the thermal efficiency of power plants bring into consideration the use of steam as a coolant for gas turbine hot gas path components.

The use of steam as a coolant for gas turbine blade cooling can provide several advantages. One advantage is that of potentially superior heat transfer. For example, when comparing typical high pressure extraction steam to compressor bleed air, steam has an up to 70% advantage in heat transfer coefficient in turbulent duct flow by virtue of its higher specific heat (other considerations being equal). The more important advantage is higher gas turbine thermal efficiency. Since the compressor bleed air is no longer needed for cooling the first and second stages, it can be put to good use as increased flow in the gas path for conversion into shaft work for higher turbine output for the same fuel heat input. There are problems associated with steam as a coolant, however, which stem from the requirement of maintaining a closed circuit and the already mentioned high supply pressures typical of reheat extraction in a steam power plant. In closed circuit cooling, the coolant is supplied and removed from the shank of the blade, and a single serpentine circuit is provided within the blade, including multiple radial outflow and radial inflow passages.

Closed circuit cooling (as opposed to open circuit cooling typically used when air is the cooling medium) is preferred because: (a) otherwise, large amounts of make-up water would be required in the steam turbine cycle (assuming a combined cycle configuration), and (b) it would be more deleterious for thermodynamic efficiency to bleed and mix steam into the gas path (as compared to air) because of steam's greater capability to quench and reduce the work capability of the hot combustion gas because of steam's higher heat capacity.

High coolant pressures are required because reheat steam is usually extracted at high pressure to optimize steam turbine cycle thermodynamic efficiency. Thin airfoil walls, usually required for cooling purposes, may not be sufficient for the pressure difference between the internal coolant, steam, and the gas path, resulting in excessive mechanical stresses. Steam pressures may be in excess of 3–5 times typical compressor bleed air (e.g. 600–1000 psi steam versus 200 psi air). A new design is thus required which can operate under high heat fluxes and high supply pressures simultaneously.

Other problems arise from the high pressure and high density steam used as a coolant. For example, the density of steam at 1000 psi psia is 3 times the density of air at 200 psia (at the same temperature, for example, 800° F.). At the same time, the heat capacity of steam is roughly twice that of air under the same conditions. This means that lesser amounts of steam mass flow are required for the equivalent convection cooling. The Buoyancy Number, $B_o$, obtained from the ratio of the buoyancy to inertia force of the forced convection flow is defined by the Grashof number divided by the Reynolds number squared ($Gr/Re^2$). With air cooled blades, undesirable buoyancy effects are typically small, $B_o << 1$. The buoyancy effects are greater with steam, however, and as the buoyancy factor $B_o$ approaches unity, the undesirable effects become even more significant. The internal coolant passages for a steam cooled system must therefore be designed to account for Coriolis and buoyancy effects, also known as secondary flow effects, explained in greater detail below.

More specifically, at the higher densities and low flow rates (lower flow velocities for a given passage cross sectional area) of steam, the cooling fluid in the internal blade cooling passages is more prone to develop secondary flows from Coriolis and centrifugal buoyancy forces which (a) affect the predictability of heat transfer and (b) impair the heat transfer by uneven heat pickup or potential flow reversal. As the blade rotates about the shaft axis, one side of the airfoil is ahead of the other in the direction of rotation. The side of the airfoil which is ahead is the leading side and the one which is behind is the trailing side. It is shown in the literature (for example, see Prakash and Zerkle, "Prediction of Turbulent Flow and Heat Transfer in a Radially Rotating Square Duct," Paper HTD-Vol. 1.88), that, when air is the coolant, flow tends to move from the high pressure region near the leading side to the low pressure region near the trailing side in the plane of the coolant passage cross section. The effects are more severe when steam is the coolant.

It has also been determined that Coriolis and buoyancy forces or effects are most significant in the radial outflow passages of the serpentine cooling circuit, particularly in the region from the pitchline (halfway between the hub and the tip of the bucket) to the tip of the bucket or blade. Accordingly, the focus in this invention is on the bucket radial outflow passage design. Any such design requires prior knowledge of the flow conditions which would set up these adverse flow recirculations at which point, passage size, and shape can be used to minimize any adverse effects.

The parameters which must be taken into account in any such design process include:

a) mass flow rate of the combustion gases entering the gas turbine;

b) heat transfer coefficients of coolants;

c) surface area to be cooled;

d) temperature of combustion gases at bucket leading edge;

e) temperature of the bucket; and f) heat flux.

In addition, certain material limitations dictate certain aspects of the design. For example, in one embodiment, the rotor itself dictates that the temperature of the coolant exiting the turbine be no more than about 1050° F. due to the properties of Inconel, for example, of which the rotor is formed. This, in turn, dictates that the steam coolant entering the turbine should be about 690°–760° F. (given a pressure of about 600–1000 psi). By the time the steam coolant reaches the first and second stages of the turbine, the temperature will be somewhat higher (about 1000° F.) and the pressure somewhat lower (about 700 psi).

In accordance with the anticipated operating parameters of this new gas turbine, combustion gases are likely to enter the first stage at about 2400° F. and the maximum metal temperature needs to be reduced to below about 1800° F. Corresponding second stage temperatures are likely to be 2000° F. and 1650°.

With these conditions set, the mass flow of coolant and coolant passage areas can be determined. At the same time, given a mass flow and inlet temperature ($T_{IN}$) for the coolant, the passages can be designed to accommodate (i.e., minimize) Coriolis and buoyancy effects.

The novel features of the turbine blade designs in accordance with this invention are thus found in the blade cooling passages and the exclusive use of high pressure steam as the blade cooling fluid in the gas turbine first and second stages. The third stage remains air cooled and the fourth stage remains uncooled in conventional fashion.

In a first exemplary embodiment, radial passages in the turbine blade are configured in a single serpentine, closed circuit, with steam entering along the trailing edge of the blade and exiting along the leading edge of the blade. The number of radial inflow and outflow passages may be any number depending upon the demands of the above design criteria. The radial passages are connected alternately by 180 degree return U-bends and each passage includes 45 degree angle raised rib turbulence enhancers.

In a transverse cross section through the pitchline of the airfoil, the radial outflow passages are made deliberately smaller than the radial inflow passages, with the exception of the radial inflow (or exit) passage along the leading edge of the airfoil. The reasons for this exception are explained further herein.

The smaller radial outflow passages counteract the tendency for any radial secondary flow recirculation resulting frown centrifugal buoyancy forces acting on the cooling fluid. This adverse tendency is counteracted by making the bulk flow velocity as large as possible in radial outflow within the confines of producibility and pressure drop. The radial outflow passages are designed with aspect ratios (length to width cross-section dimensions for the passages), such that buoyancy parameters lead to maximized heat transfer rate on the leading side of the passage as substantiated by test results. The target regime of operation in radial outflow is a Buoyancy Number of less than 0.15 or greater than 0.8 for passages with an aspect ratio of 3.3 to 1. As already noted above, it is known that the adverse effect of Coriolis and buoyancy forces are more benign to radial inflow passages when air is used as the coolant. (See, for example, Wagner, J. H., Johnson, B., and Kopper, F., "Heat Transfer in Rotating Serpentine Passages with Smooth Walls," ASME Paper 90-GT-331, 1990.) We have confirmed that this is also the case for steam. As such, the radial inflow passages are kept relatively large within the confines of desired heat transfer coefficients and pressure drop constraints.

The above embodiment also features the use of turbulence enhancing raised ridges or trip strips to enhance the heat transfer rate. These features have the additional benefit of reducing the adverse effects of buoyancy and Coriolis forces as the local turbulence breaks up secondary flow tendencies.

This effect also has been documented (for air) in the literature (see, for example, Wagner, J. H., Steuber, G., Johnson, B., and Yeh, F., "Heat Transfer in Rotating Serpentine Passages with Trips Skewed to the Flow". Rows of pins may also be used in trailing edge passages for both mechanical strength and heat transfer.

Cooling the tip portion of a closed circuit cooled blade presents additional problems. Typical high technology open circuit air cooled designs bleed coolant near the tip to reduce the heat flux around the tip periphery of the airfoil. The reduced heat fluxes reduce the temperature gradient through the wall and the associated thermal stresses. In closed circuit cooling, the mechanism for solving the problem is solely by internal convective cooling.

Tip cooling is addressed by incorporating raised ribs on the underside of the blade tip cap. These ribs increase the local turbulence and thus enhance the rate of heat transfer.

Another feature is the incorporation of bleed holes at the juncture where the rib meets the wall and the tip cap. The aforementioned feature provides relief from high thermal stresses by unconstraining the corner region from the relatively cold rib. The situation is further improved by chamfering or radiusing the external corner at the juncture of the airfoil wall and the tip cap. This reduces the effective wall thickness and reduces the temperature gradient across the wall of the airfoil around the periphery of the tip cap.

In a variation of the above design, the flow is reversed, i.e., the flow moves radially outward through the leading edge passage and then follows a similar serpentine arrangement, in reverse, exiting through the trailing edge passage.

It has also been found that incorporation of the disclosed embodiments in actual blade design may require coupling with a thermal barrier coating on the blade outer surface to keep blade temperature within acceptable limits.

In one aspect, therefore, the present invention may be defined as comprising a gas turbine bucket having a shank portion, a radial tip portion and an airfoil having leading and trailing edges and pressure and suction sides, and an internal fluid cooling circuit, the improvement comprising the internal fluid cooling circuit having a serpentine configuration including plural radial outflow passages and plural radial inflow passages, the radial outflow passages shaped to have aspect ratios of about 3.3 to 1 and Buoyancy Numbers of <0.15 or >0.80.

In another aspect, the invention may be defined as comprising a gas turbine bucket having a shank portion, a radial tip portion and an airfoil extending between the shank portion and the radial tip portion, the airfoil having leading and trailing edges and pressure mad suction sides, and an internal fluid cooling circuit, the improvement comprising the internal fluid cooling circuit having a serpentine configuration including plural radial outflow passages and plural radial inflow passages, the radial outflow passages having, on average, smaller cross-sectional areas than the radial inflow passages.

In still another aspect, the invention relates to a method of determining a configuration for steam cooling passages for a bucket stage in a gas turbine comprising the steps of:

a) determining combustion gas inlet temperature and mass flow rate of combustion gases passing through the gas turbine stage;

b) taking into account Coriolis and buoyancy flow effects in the steam coolant caused by rotation of the bucket stage; and c) configuring the radial inflow and outflow coolant passages to have a size and shape to provide aspect ratios of about 3.3 to 1 and Buoyancy Numbers of <0.15 or >0.8 in said radial outflow passages.

The advantages which accrue from this invention can be summarized as follows:

1. Closed circuit steam cooling using high pressure steam achieves bulk cooling effectiveness greater than that of open circuit air cooling.

2. Closed circuit steam cooling of turbine blades increases gas turbine thermodynamic efficiency by eliminating parasitic compressor bleed flow for turbine blade cooling.

3. The adverse effects of the rotational Coriolis and buoyancy forces and possible flow reversal in outward flow have been reduced through proper passage design for the flow rate of coolant, particularly in the radial outflow passages.

4. The adverse effects of the rotational Coriolis and buoyancy forces and possible flow reversal have been further reduced by the use of turbulator ribs or trip strips.

5. A more even distribution of heat transfer rate around the periphery of the coolant cavity has been maximized by the passage design.

6. Regions of flow stagnation in the tip turnaround have been eliminated by the use of turning vanes and/or raised rib turbulators.

7. Tip cooling has been enhanced by use of raised rib turbulators on the underside of the cap.

8. Thermal stresses at the outer periphery of the tip cap are relieved by bleed holes which are placed at the juncture of the rib, the airfoil wall and the tip cap.

9. The passages have been designed to maximize heat transfer and sustain high internal pressures.

Advantages and benefits beyond those discussed above will become apparent from the detailed description which follows.

BRIEF DESCRIPTION OF THE DRAWINGS

FIGS. 10A–C are sections of a second stage blade, taken at the hub, pitchline, and tip, respectively;

FIG. 15 is a partial section of a first stage turbine blade in accordance with another exemplary embodiment of the invention;

FIG. 16 is a partial section of a first stage turbine blade in accordance with still another exemplary embodiment of the invention;

BEST MODE FOR CARRYING OUT THE INVENTION

Figure 1:
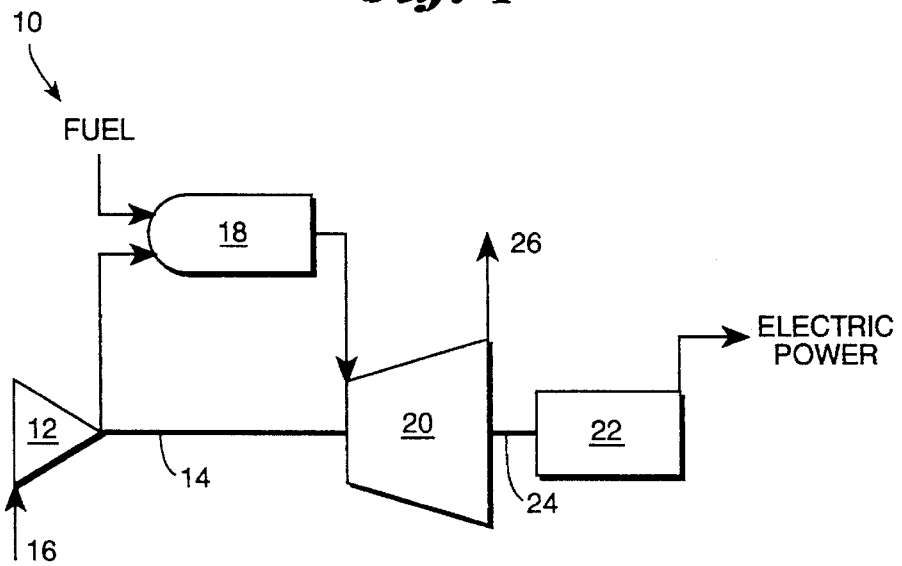
FIG. 1 is a schematic diagram of a simple cycle, single shaft, heavy duty gas turbine.

FIG. 1 is a schematic diagram for a simple-cycle, single-shaft heavy duty gas turbine 10. The gas turbine may be considered as comprising a multi-stage axial flow compressor 12 having a rotor shaft 14. Air entering the inlet of the compressor at 16 is compressed by the axial flow compressor 12, and then is discharged to a combustor 18 where fuel such as natural gas is burned to provide high energy combustion gases which drive a turbine 20. In the turbine 20, the energy of the hot gases is converted into work, some of which is used to drive compressor 12 through shaft 14, with the remainder being available for useful work to drive a load such as a generator 22 by means of rotor shaft 24 (an extension of the shaft 14) for producing electricity. A typical simple-cycle gas turbine will convert 30 to 35% of the fuel input into shaft output. All but one to two percent of the remainder is in the form of exhaust heat which exits turbine 20 at 26.

Figure 2:
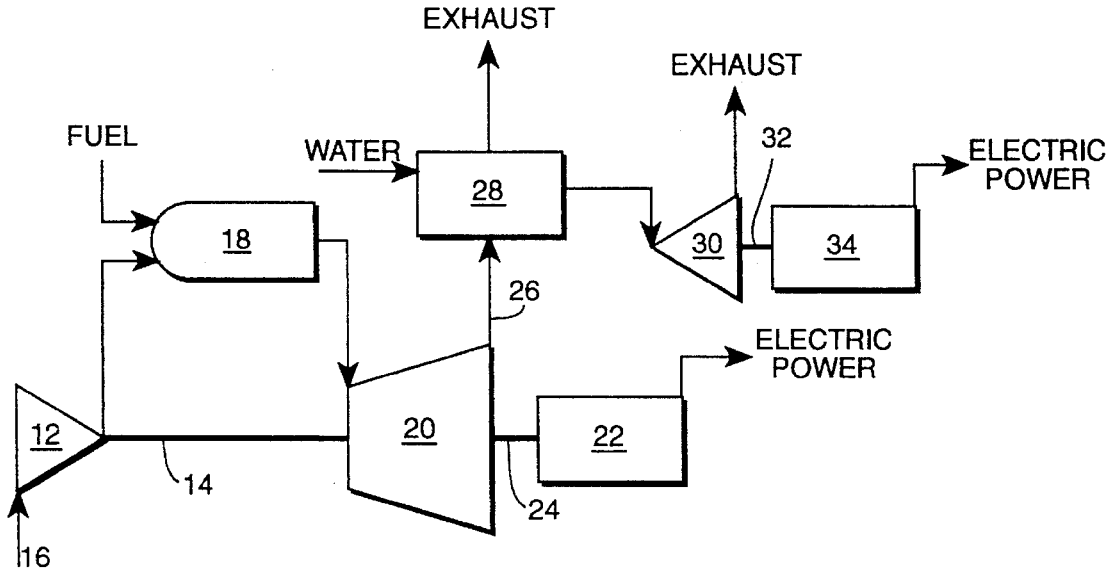
FIG. 2 is a schematic diagram of a combined cycle gas turbine/steam turbine system in its simplest form.

FIG. 2 represents the combined cycle in its simplest form in which the energy in the exhaust gases exiting turbine 20 at 26 is converted into additional useful work. The exhaust gases enter a heat recovery steam generator (HRSG) 28 in which water is converted to steam in the manner of a boiler. The steam thus produced drives a steam turbine 30 in which additional work is extracted to drive through shaft 32 an additional load such as a second generator 34 which, in turn, produces additional electric power. In some configurations, turbines 20 and 30 drive a common generator. Combined cycles producing only electrical power are in the 50% to 60% thermal efficiency range using the more advanced gas turbines.

In the present invention, steam used to cool the gas turbine buckets in the first and second stages may be extracted from a combined cycle system in the manner described in commonly owned application Ser. No. 08/161,070 filed Dec. 3, 1993. This invention does not relate to the combined cycle per se, but rather, to the configuration of internal steam cooling passages in the first and second stage gas turbine buckets, consistent with the discussions above.

Figure 3:
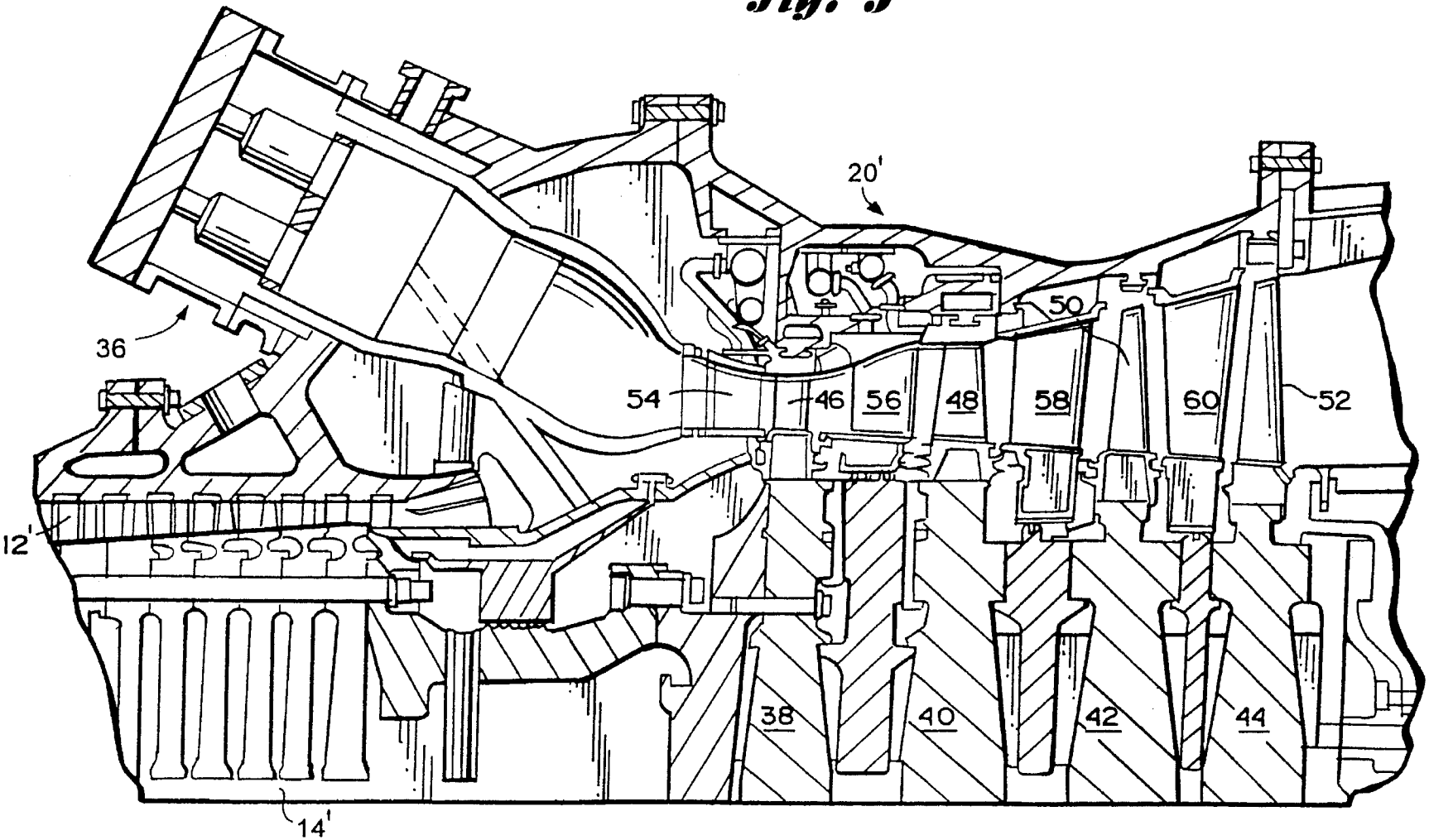
FIG. 3 is a partial cross section of a portion of the gas turbine in accordance with the invention.

FIG. 3 illustrates in greater detail the area of the gas turbine which is the focus of this invention. Air from the compressor 12' is discharged to the several combustors located circumferentially about the gas turbine rotor 14' in the usual fashion, one such combustor shown at 36. Following combustion, the resultant gases are used to drive the gas turbine 20' which includes in the instant example, four successive stages, represented by four wheels 38, 40, 42 and 44 mounted on the gas turbine rotor for rotation therewith, and each including buckets or blades represented respectively, by numerals 46, 48, 50 and 52 which are arranged alternately between fixed stators represented by vanes 54, 56, 58 and 60. This invention relates specifically to steam cooling of the first and second stage buckets, represented by blades 46, 48, and the minimization of secondary Coriolis and centrifugal buoyancy forces or effects in the internal blade cooling passages.

Figure 4:
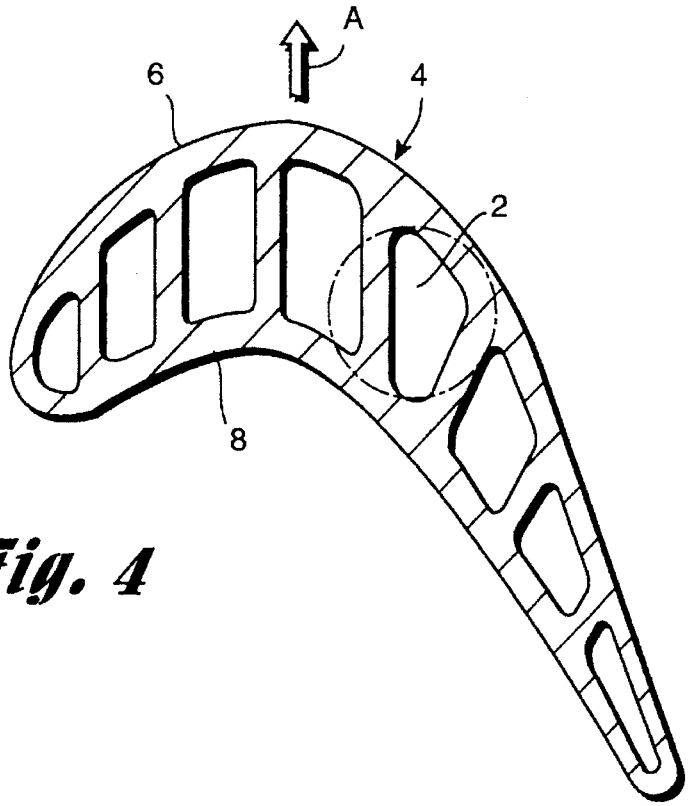
FIG. 4 is a section through a typical turbine blade with internal cooling passages.
Figure 4A:
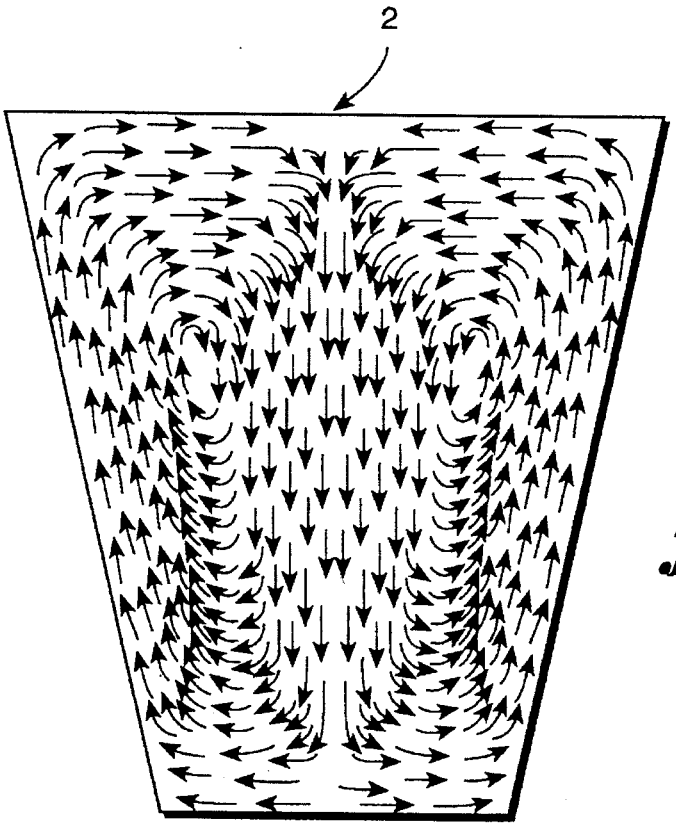
FIG. 4A is an enlarged, planar representation of a flow passage from FIG. 4, and illustrating secondary flow effects.

Referring to FIGS. 4 and 4A, a typical passage 2 is shown in a blade having a leading (or suction) side 6 and a trailing (or pressure) side 8. The Coriolis induced secondary flow (assume rotation in the direction of arrow A) transports cooler, higher momentum fluid from the core to the trailing side 8, whereby the radial velocity, the temperature gradient and hence the convective effects are enhanced. Centrifugal buoyancy increases the radial velocity of the coolant near the trailing side 8, further enhancing the convective effect. For the leading side 6, the situation is just the reverse. Due to the Coriolis induced secondary flow, the fluid exchanges heat with the trailing side 8 and side walls before reaching the leading side 6. The fluid adjacent to the leading side 6 is warmer and the temperature gradient in the fluid is lower, weakening the convection effect. For the same :reason, the Coriolis induced flow leads to a lower radial velocity adjacent to the leading side 6, weakening the convection effect further. Buoyancy effects become stronger at high density ratios such that flow reversal can occur adjacent to the leading side 6 of the passage 2. One of the objectives of this invention is to account for the presence of these secondary flows in order to mitigate the adverse effects by appropriate design of the internal cooling passages in the buckets, and particularly the radial outflow passages where the secondary flow effects are more severe.

Figure 5:
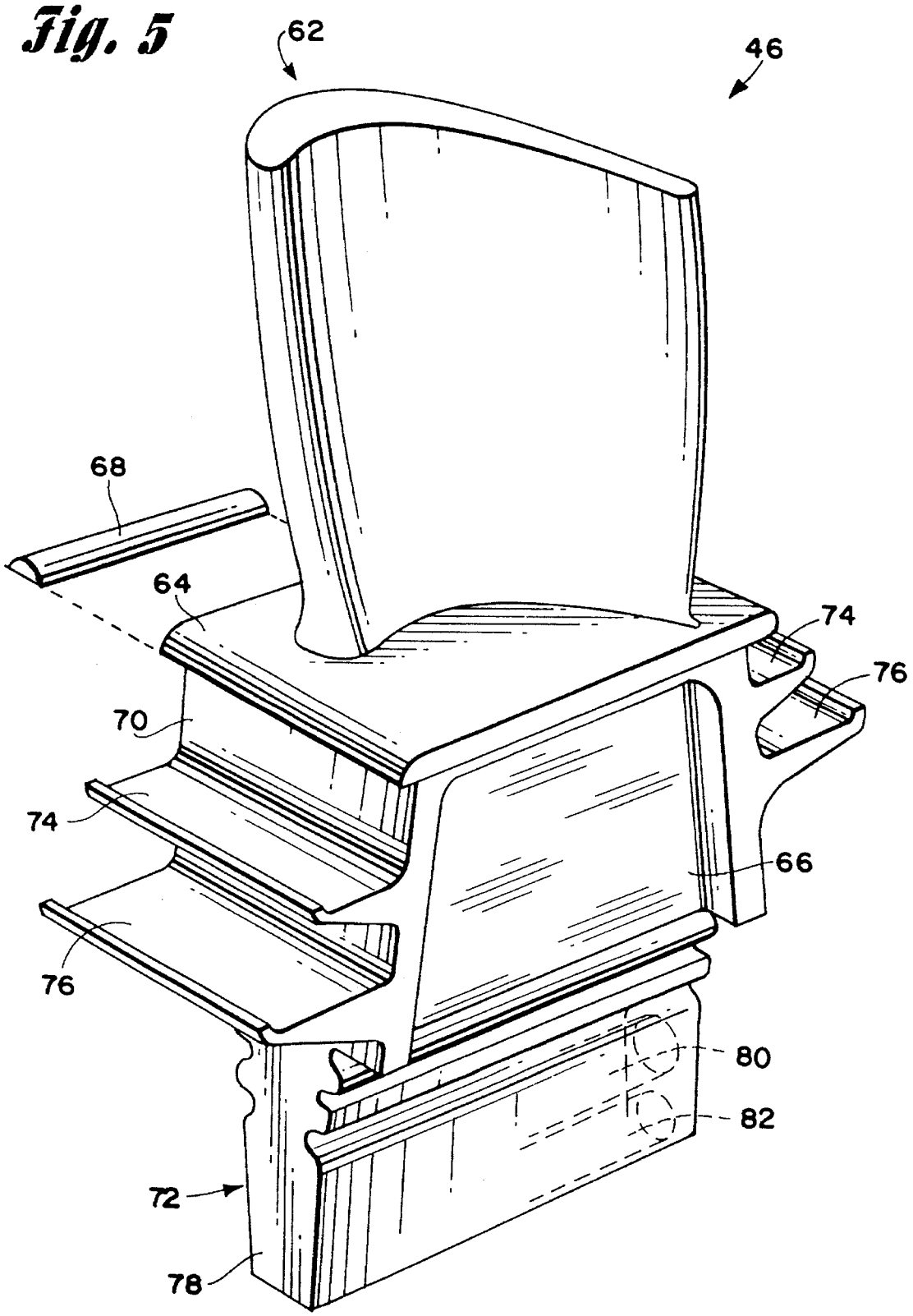
FIG. 5 is a perspective view of a first stage turbine blade in accordance with this invention.

Referring now to FIG. 5, the external appearance of the gas turbine first stage bucket 46 in accordance with this invention is shown. The external appearance of the blade or bucket 46 is typical compared to other gas turbine blades, in that it consists of an airfoil 62 attached to a platform 64 which seals the shank 66 of the bucket from the hot gases in the flow path via a radial seal pin 68. The shank 66 is covered by two integral plates or skirts 70 (forward and aft) to seal the shank section from the wheelspace cavities via axial seal pins (not shown). The shank is attached to the rotor disks by a dovetail attachment 72. Angel wing seals 74, 76 provide sealing of the wheelspace cavities. A novel feature of the invention is the dovetail appurtenance 78 under the bottom shank of the dovetail which supplies and removes cooling steam from the bucket via axially arranged passages 80, 82 shown in phantom, which communicate with axially oriented rotor passages (not shown).

Figure 6:
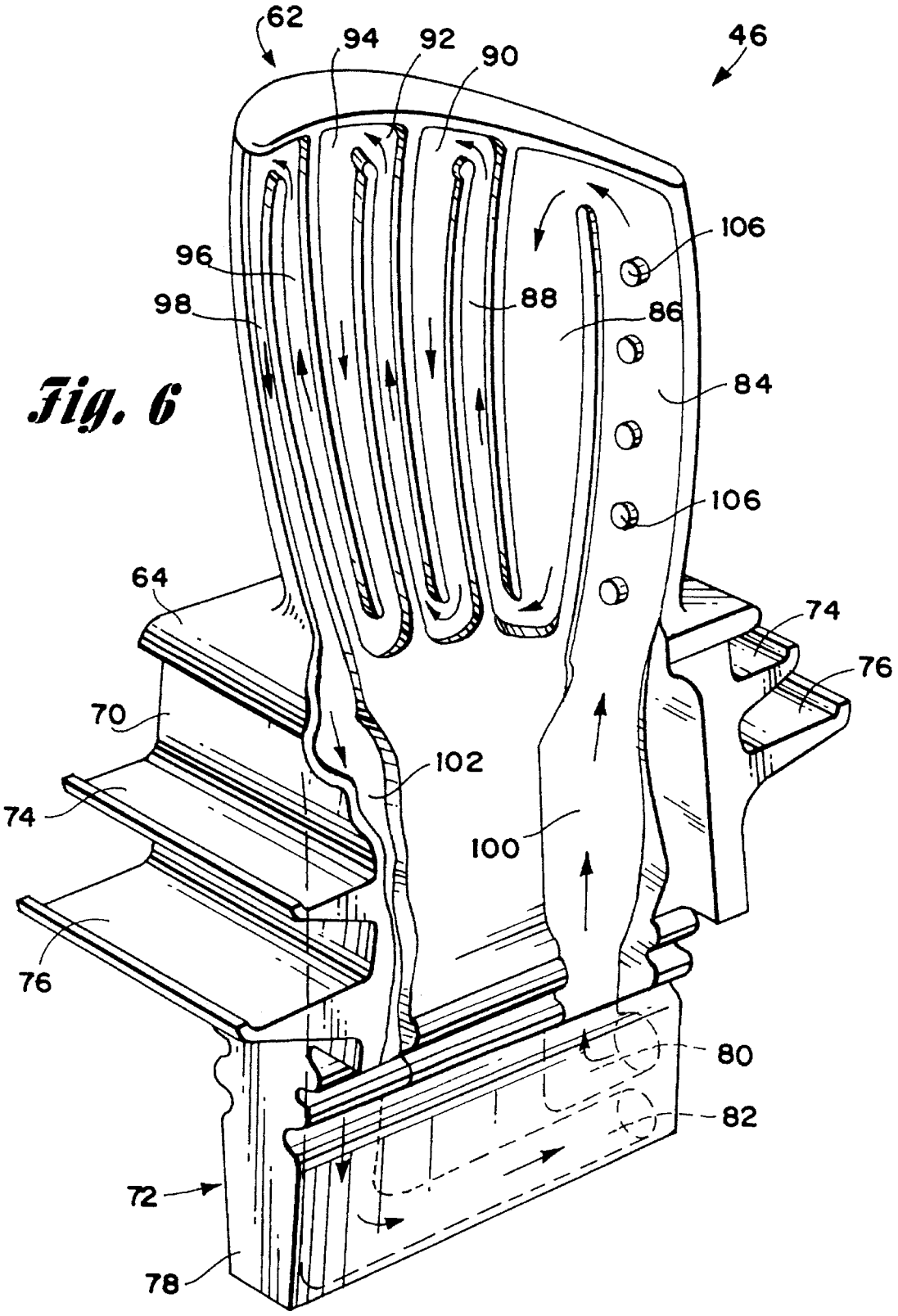
FIG. 6 is a perspective view similar to FIG. 5 but broken away to show internal cooling passages.

FIG. 6 illustrates in simplified form, the internal cooling passages in the first stage bucket 46. Steam entering the bucket via passage 80 flows through a single, closed serpentine circuit having a total of eight radially extending passages 84, 86, 88, 90, 92, 94, 96 and 98 connected alternatively by 180° return U-bends. Flow continues through the shank via the radial inflow passage 98 which communicates with the axially arranged exit conduit 82. Outflow passage 84 communicates with inlet passage 80 via passage 100, while inflow passage 98 communicates with exit passage 82 via radial passage 102. The total number of radial passages may vary in accordance with the specific design criteria.

Figure 7:
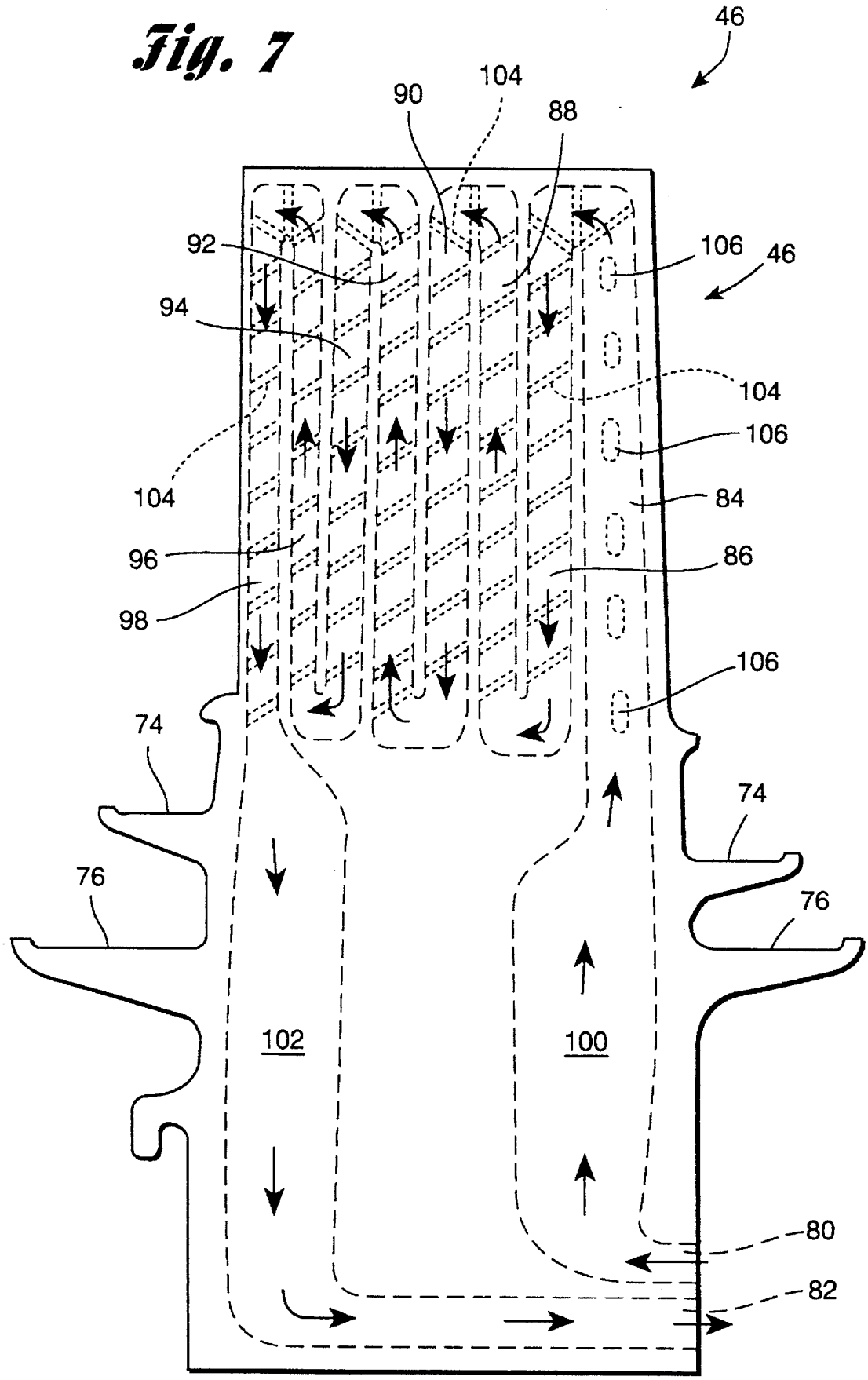
FIG. 7 is a planar side view of the blade shown in FIG. 5, with internal passages shown in phantom.
Figures 8A, 8B, 8C:
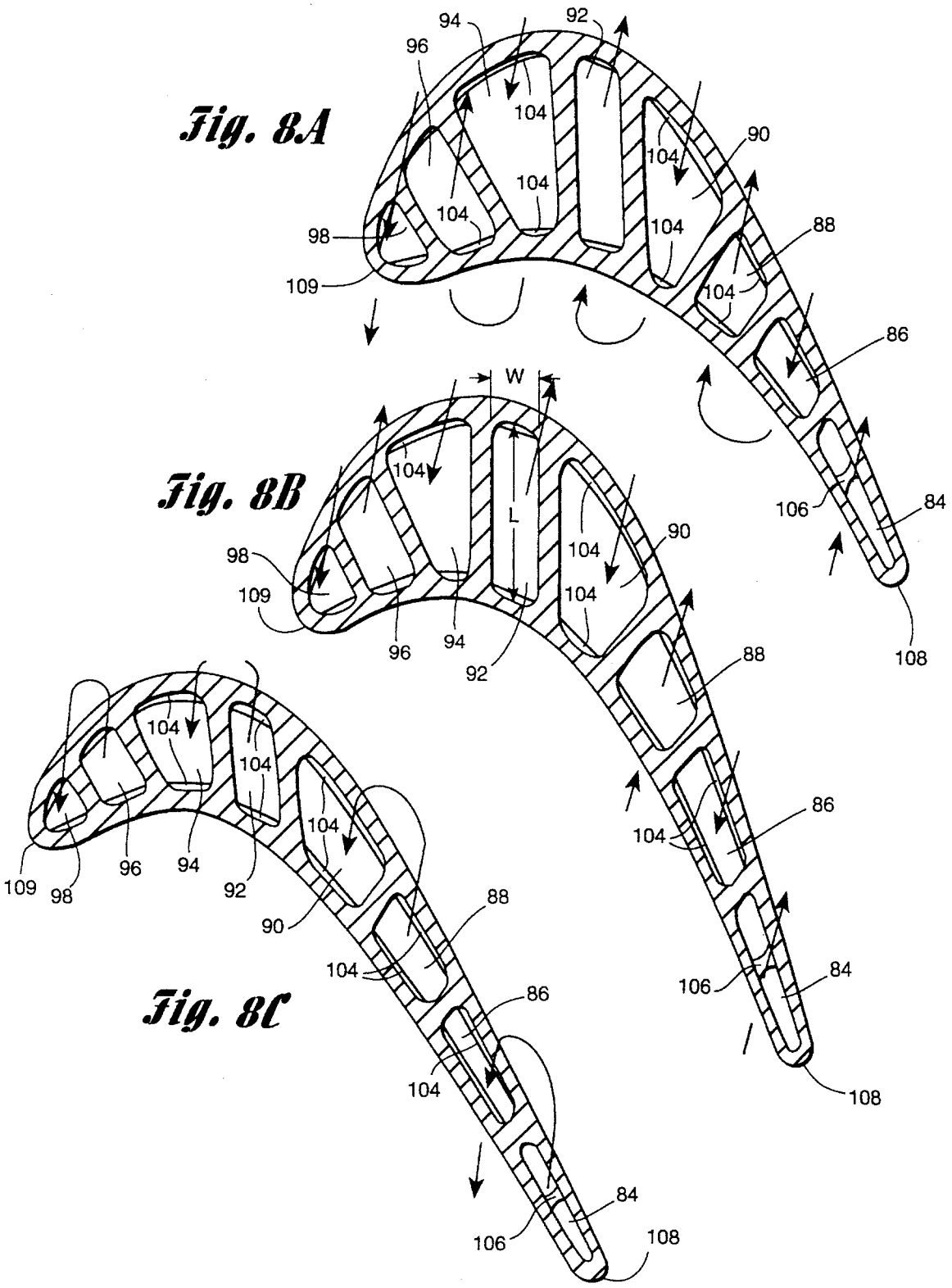
FIGS. 8A–C are sections of a first stage gas turbine blade in accordance with the invention, the sections taken at the hub, pitchline and tip of the blade, respectively.

FIG. 7 is a schematic planar representation of the bucket shown in FIG. 4, and illustrates the incorporation of integral, raised ribs 104 generally arranged at 45° angles in the radial inflow and outflow passages, after the first radial outflow passage, which serve as turbulence enhancers. These ribs also appear at different angles in the 180° U-bends connecting the various inflow and outflow passages. Referring to FIGS. 8A–8C, it can be seen that turbulator ribs 104 are provided along both the leading (or low pressure) side and the trailing (or pressure) side of the blade or bucket 46.

Pins 106 (FIGS. 6, 7) provided in the radial outflow passage 84 adjacent the trailing edge improve both mechanical strength and heat transfer characteristics. These pins may have different cross-sectional shapes as evident from a comparison of FIGS. 6 and 7.

FIG. 8A represents a transverse section through the root of the blade 46 and the flow arrows indicate radial inflow and outflow in the various passages 84, 86, 88, 90, 92, 94, 96 and 98. Note, again that the cooling steam flows into the bucket initially via passage 84 adjacent the trailing edge 108 and exits via passage 98 adjacent the leading edge 109. The radial outflow passages 84, 88, 92 and 96 are made smaller than radial inflow passages 86, 90, 94 with the exception of the radial inflow passage 98 adjacent the leading edge 109 for reasons explained below. As already noted, the adverse effect of Coriolis and buoyancy forces are more benign in radial inflow passages, and these passages are therefore kept relatively large.

The leading edge passage 98 requires a high heat transfer coefficient. This is forced by reducing the flow area to raise the bulk flow velocity, which in turn raises the heat transfer coefficient which is proportional to mass flow divided by the perimeter raised to the 0.8 power. The smaller cross section of passage 98 results in a smaller perimeter, thus raising the heat transfer coefficient.

The generally smaller radial outflow passages 84, 88, 92 and 96 counteract the tendency for any radial secondary flow recirculation resulting from Coriolis and centrifugal buoyancy forces acting on the fluid in radial outflow. This adverse tendency is counteracted by making the bulk flow velocity as large as possible in radial outflow within the confines of producibility and pressure drop. The radial outflow passages 84, 88, 92 and 96 are thus designed such that buoyancy parameters lead to enhanced heat transfer rate on the leading side of the outflow passages.

FIG. 8B illustrates the same bucket 46, but with the cross-section taken at the pitchline of the blade, halfway between the hub or root and the tip. FIG. 8C shows the same blade at the radially outer tip. From these views, the relative changes in passage geometry from root to tip may be appreciated.

With a judicious selection of aspect ratios (the ratio of length dimension "L" to the width dimension "W" as shown in FIG. 8B) and cross-sectional area ratios in the radial outflow passages, as explained below, it is possible to achieve, for a given aspect ratio, a buoyancy factor (for steam) of <1, and even as low as 0.15 in the radial outflow passages 84, 88, 92 and 96 where secondary flow effects are critical. In this way, the unwanted secondary flow effects (buoyancy and Coriolis) can be minimized particularly in the radial outflow passages, while at the same time maximizing local heat transfer. In this regard, it has been determined that it is desirable to achieve a heat transfer enhancement factor $$\left(\frac{\text{actual heat transfer}}{\text{heat transfer in a smooth tube}}\right)$$

as high as possible. For example, when the radial outflow passages are shaped to have an aspect ratio of about 3.3 to 1, it has been determined that, with regard to heat transfer enhancement and Buoyancy Number ($B_o$), an enhancement factor of 2 is achievable with a corresponding $B_o$ of 0.15. Between $B_o$'s of 0.15 and 0.80, it has been discovered that the enhancement factor drops below 2. As a result, radial outflow passages should be designed to have $B_o$'s of less than 0.15 or greater than 0.80 when the aspect ratio is about 3.3 to 1.

For purposes of the above analysis, the passages were also provided with turbulators 104.

It is expected that a similar undesirable range of Buoyancy numbers will be identified for other aspect ratios, but this has not yet been confirmed.

It will be appreciated that these aspect ratios will change somewhat along the length of the blade, from hub to tip due to the changing curvature and twist of the blade. At the same time, the cross-sectional area ratio between the larger radial inflow passages (with the exception of the smaller radial inflow passage along the leading edge) and the smaller radial outflow passages at the pitchline, on average, should be about 1 ½ to 1.

Since secondary flow effects are typically more significant in first stage buckets, it follows that aspect ratio effects are also more significant in the first stage buckets. Thus, in the second stage buckets, the aspect ratios may be on the order of 1 to 1 or 2 to 1, while the cross-sectional area ratios may remain substantially as for the first stage buckets. Once having determined the configuration of the radial outflow passages, the radial inflow passages can be configured consistent with requirements relating to heat transfer coefficients and pressure drop constraints.

It should be noted here that the turbulence enhancing ribs or turbulators 104 also tend to reduce the adverse effects of buoyancy and Coriolis forces as the local turbulence breaks up secondary flow tendencies.

FIGS. 9 and 10A–10C illustrate a second stage bucket in views which generally correspond to the first stage bucket shown in FIGS. 6 and 8A–8C. The stage two bucket 110 has six cooling passages, as opposed to the eight passages in the first stage bucket, reflecting the reduced cooling requirements in the second stage. Thus, radial outflow passages 112, 116 and 120 alternate with radial inflow passages 114, 118 and 122 in a single, closed serpentine circuit. The first radial outflow passage 112 is connected to axial supply conduit 124 via passage 126 while the last radial inflow passage 122 is connected to axial return conduit 128 via passage 130. Pins 132 appear in the last radial inflow passage 122, and it will be appreciated from FIGS. 10A–10C that raised ribs 134 are provided as in the stage one buckets. The Buoyancy Number, aspect ratio and cross-sectional area ratios are as stated above.

Figure 9:
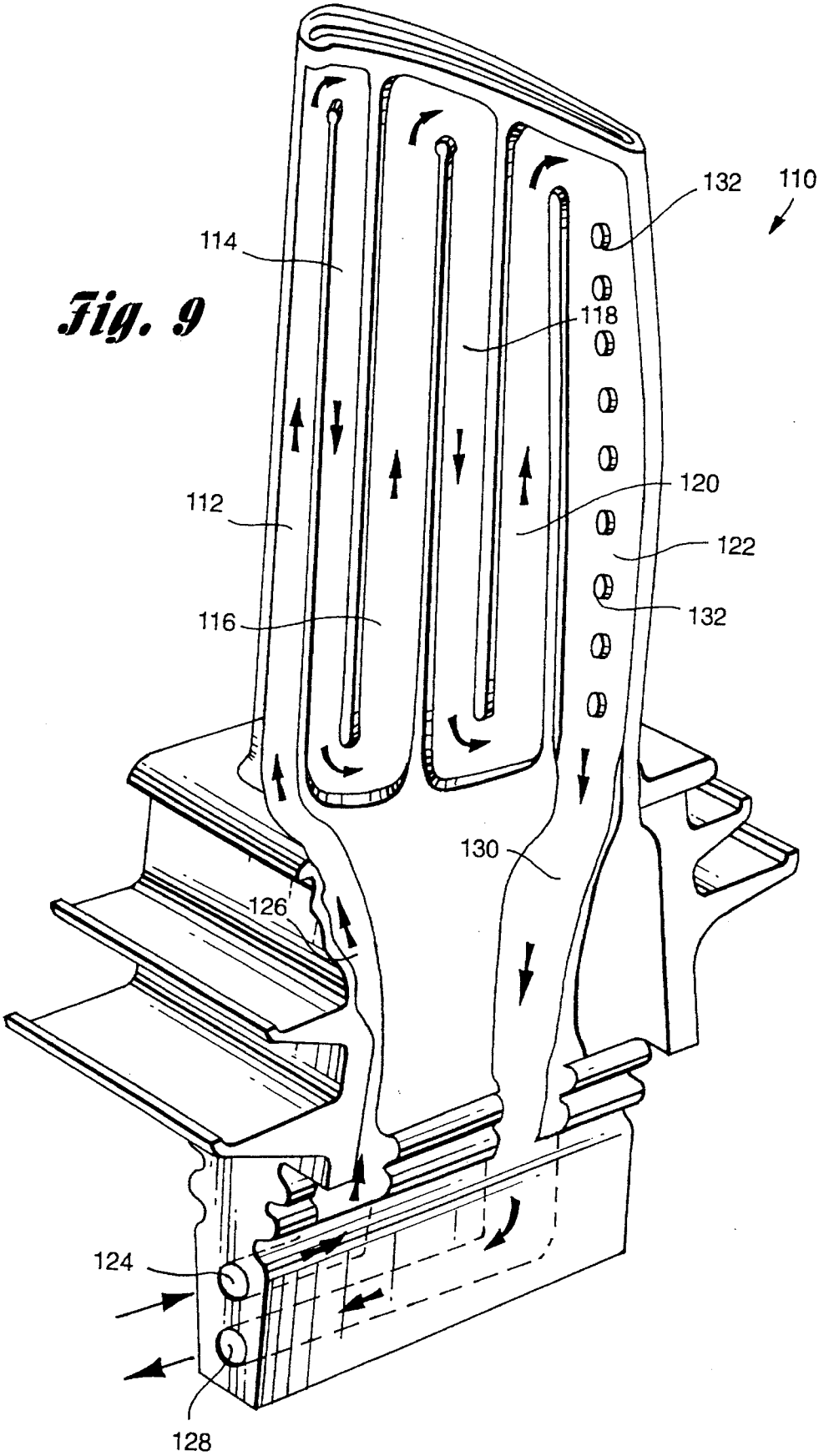
FIG. 9 is a perspective view, partly in section, of a second stage turbine blade in accordance with the invention.

An alternative design variation is also illustrated in FIG. 9. Specifically, the steam coolant flow path is reversed, i.e., steam enters the bucket 110 and flows radially outwardly in leading edge passage 112 and exits the bucket via trailing edge passage 122. This arrangement may be advantageous in some circumstances.

Figure 11:
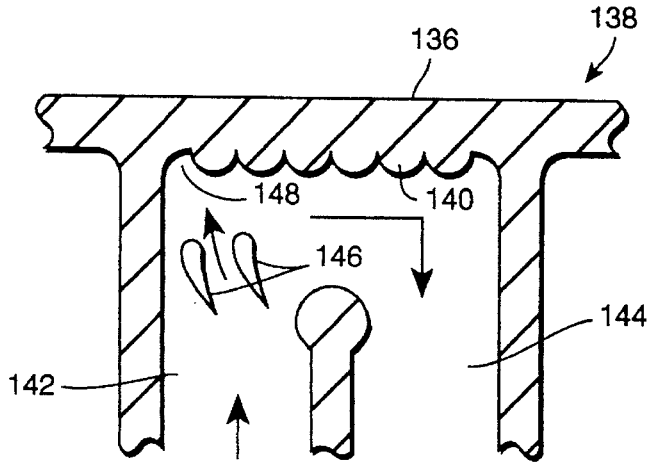
FIG. 11 is a partial, enlarged section of a blade tip, illustrating internal tip cooling in accordance with the invention.
Figure 12:
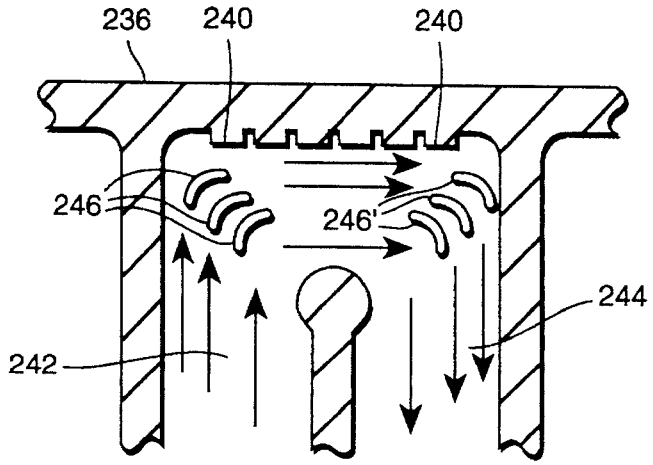
FIG. 12 is a view similar to FIG. 11 but illustrating an alternative blade tip cooling arrangement.
Figure 13:
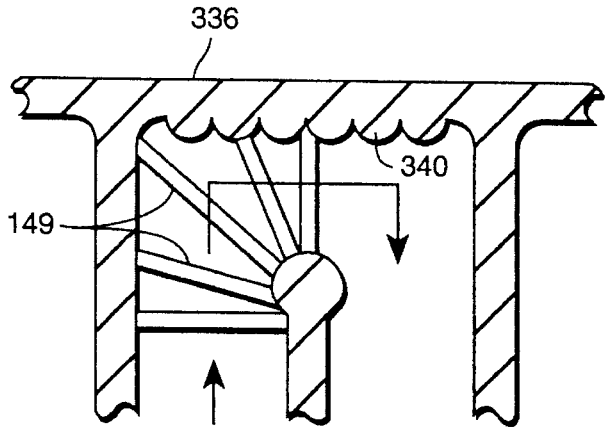
FIG. 13 is a view similar to FIG. 11 but illustrating another blade tip cooling arrangement in accordance with the invention.

In both first and second turbine stages, the bucket tips are cooled by providing raised ribs on the underside of the tip cap as shown in FIGS. 11–13. In FIG. 11, for example, the tip cap 136 of a bucket 138 is formed with integral ribs 140 on the underside of the cap in a U-bend between radial outflow passage 142 and radial inflow passage 144. Turning vanes 146 may be located in outflow passage 142 to direct flow into the turnaround cavity corner 148 which is a typical location of stagnant flow and insufficient cooling. In FIG. 12, integral ribs 240 of squared off configuration are provided on the underside of the tip cap 236, in further combination with turning vanes 246 and 246' in both outflow and inflow passages 242, 244, respectively. In FIG. 13, raised rib turbulators or trip strips 149 are provided in the 180° U-bend region and on the underside of the tip cap 336 in combination with rounded ribs 340 on the underside of the tip cap. These features also increase local turbulence but, at least with regard to the turning vanes 146 and turbulators 149, may not provide any heat transfer enhancement.

Figure 14A:
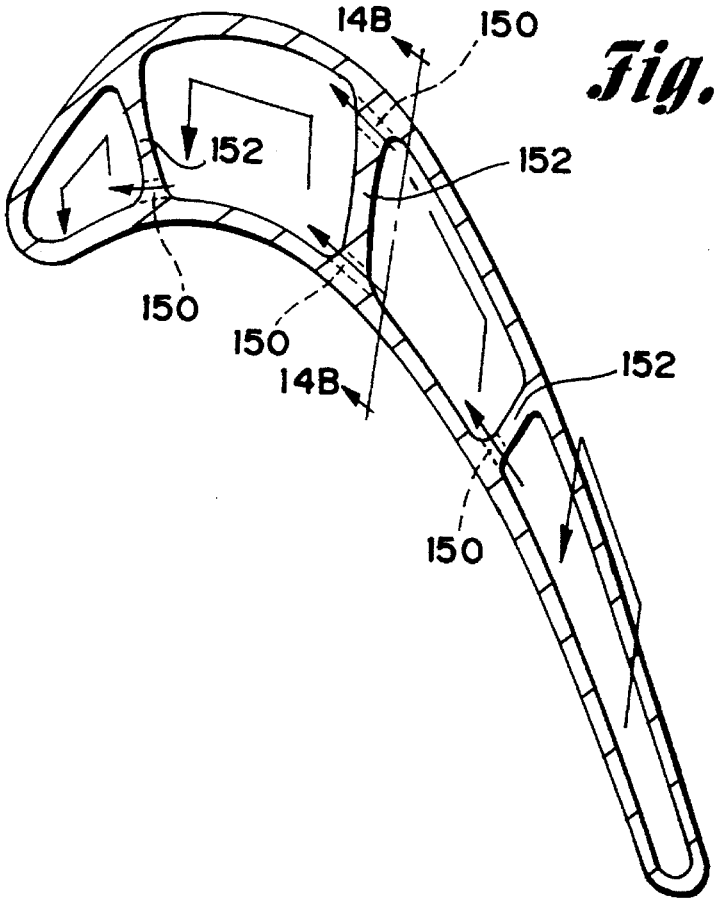
FIG. 14A is a section through a blade illustrating bleed holes in the passages dividers in accordance with the invention.
Figure 14B:
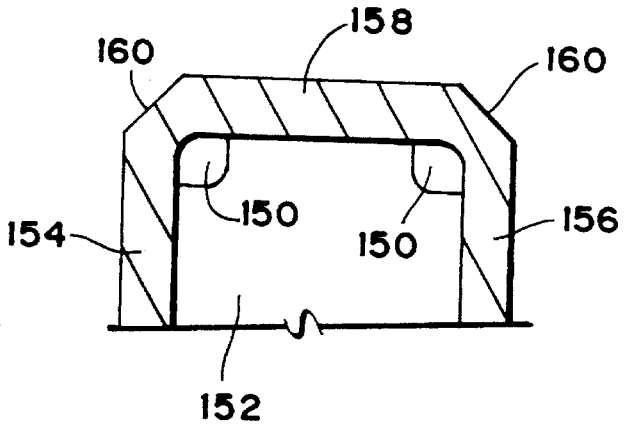
FIG. 14B is a partial section taken along the line 14B—14B in FIG. 14A.

In FIGS. 14A and 14B, it can be seen that bleed holes 150 may be provided where the passageway divider rib 152 meets the blade walls 154, 156 and the tip cap 158. This feature tends to provide relief from high thermal stresses by unconstraining the corner region from the rib. Additional benefits may be gained by chamfering or radiusing the external corners of the blade at 160. This reduces the effective wall thickness and reduces the temperature gradient across the wall of the airfoil around the periphery of the tip cap 158.

Turning to FIGS. 15–18, alternative design configurations for first stage turbine buckets are shown which are intended to enhance heat transfer in the generally triangularly shaped (in cross section) trailing edge cooling passage. The flow adjacent the trailing edge is laminar due to the constriction of the core flow between the boundary layers. It should be noted that the second stage bucket does not experience the same trailing edge phenomenon, so long as the trailing edge wedge angle is below about 12°.

With specific reference now to FIG. 15, parallel flow passages 162, 164 are provided near the trailing edge 166 of the blade 168, fed from the same entry passage 170. One passage 164 is intended to enhance heat transfer at the trailing edge through an arrangement of opposed baffles 172, 174. The other branch or passage 162 is intended to enable a high through flow by providing a bypass to minimize overall pressure drop. Both passages meet near the blade tip to continue into the serpentine circuit, and specifically into a radial inflow passage 176. In this embodiment, the trailing edge passage 164 with its arrangement of baffles 172, 174, forces turbulence through the trailing edge region via vortices caused by U-return bends (similar to the return bends at the blade tip) between adjacent baffles projecting alternately from opposite sides of the passage 164. Passage 164 will have 10–20% of the total flow from entry passage 170 because of the high flow resistance from the head losses in all of the U-bends. In the exemplary embodiment, there are about 10 such U-bends (eleven baffles 172, 174 are shown).

Tests indicate that enhancement factors of 1.5 to 2 are possible at the U-bends at the blade tip. With ten baffles in the passage 164, an exit hydraulic diameter prior to the U-bends of about 0.35 inches will result in a smooth wall heat transfer coefficient of about 500 BTU/ft.$^2$. The turbulence enhancement will bring the effective heat transfer coefficient to about 1000 BTU/ft.$^2$. In addition, the number of serpentine inflow and outflow passages hydraulic diameter prior to the U-bends of about 0.35 inches will result in a smooth wall heat transfer coefficient of about 500 BTU/ft.$^2$. The turbulence enhancement will bring the effective heat transfer coefficient to about 1000 psi BTU/ft.$^2$. In addition, the number of serpentine inflow and outflow passages can be reduced in this embodiment to six, in order to keep overall flow in excess of 30 pps. It is important to keep total flow rate at about 30 pps or greater, in order to keep exit temperatures below 1050° F., and to maximize leading edge heat transfer.

The flow split along the trailing edge 166 of the blade 168, and the overall pressure drop, will be controlled by several variables including (a) the relative size of the bypass radial outflow passages; Co) the degree of overlap of the baffles 172, 174; (c) the number of baffles; (d) the angle of inclination of the baffles, and particularly the radially innermost baffle; and (d) inlet and/or exit constrictions in the trailing edge flows.

A variation of the above trailing edge passage configuration is illustrated in FIG. 16 where two parallel bypass passages 178 and 180 extend parallel to the trailing edge passage 182, Here again, the radial outflow passages 178, 180 and 182 split from a common entry or supply passage (not shown) similar to passage 170 in the FIG. 15 embodiment. This arrangement increases the percent of coolant bypassing the trailing edge passage 182.

Figure 17:
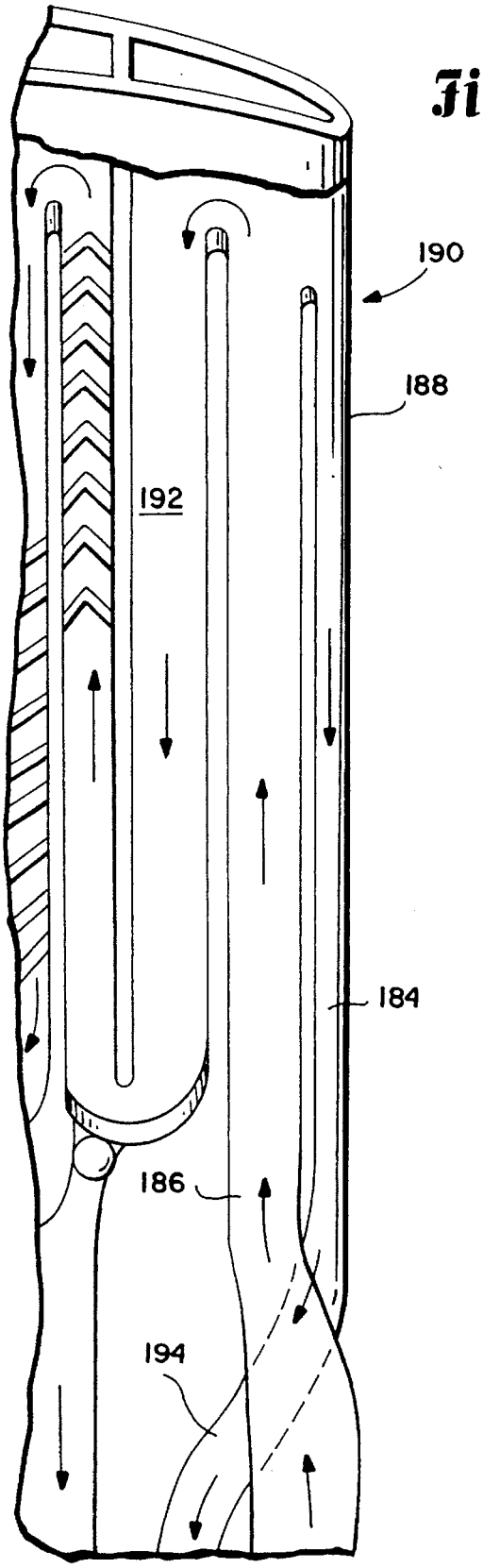
FIG. 17 is a partial section of a first stage turbine blade in accordance with still another exemplary embodiment of the invention.
Figure 18:
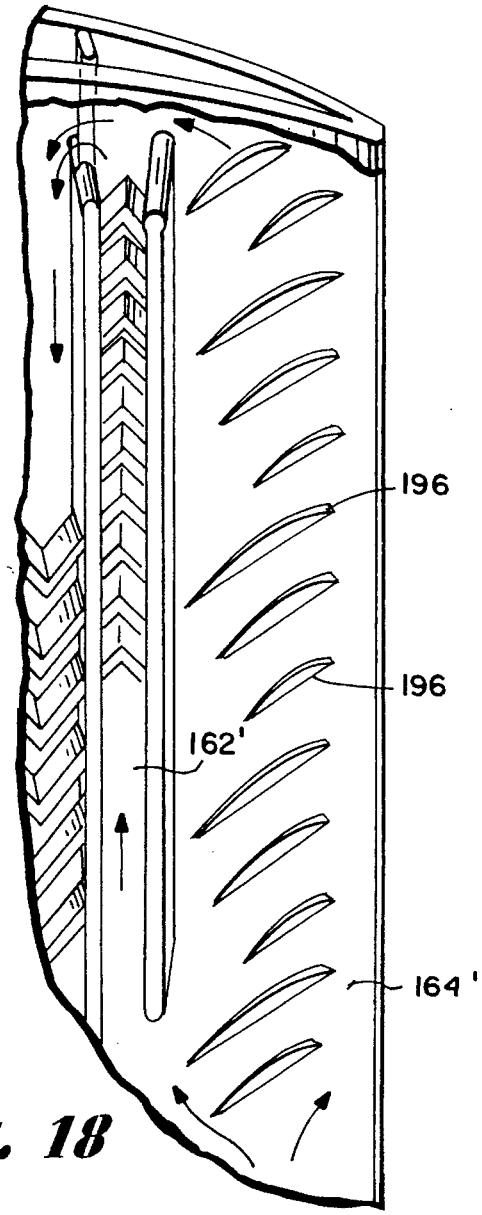
FIG. 18 shows a variation of FIG. 15.

Turning to FIG. 17, a radial outflow passage arrangement involves parallel passages 184, 186 along the trailing edge 188 of the blade 190. Flow from radial outflow passage 186 splits at the blade tip, with some of the flow moving into the narrow diameter inflow trailing edge passage 184, and some of the flow moving into an interior radial inflow passage 192 in the closed serpentine circuit. The edge passage 184 exits, into a passage 194 leaving the blade FIG. 18 illustrates a variation of FIG. 15 where vanes 196 are utilized in the trailing edge passage 164' in place of baffles 172, 174 to promote turbulence. Here again, the flow distribution is controlled by variables discussed above in connection with FIG. 15.

It should also be noted that chevron turbulators 198 as illustrated in FIGS. 15–18, may be preferred in particular circumstances over the 45° turbulators 104 in the earlier described embodiments, in light of higher heat transfer enhancement with this type of turbulence promotor for the same pressure drop. Some 45° angle turbulators may be retained, however, if particular passages are too small to accommodate a chevron-shaped turbulator. It will be appreciated that various configurations of 45° and chevron-shaped turbulators may be included. It has also been determined that the first one third of the passage length, as measured from the flow entry point, may be left unturbulated in order to minimize pressure drop. In addition, inlet entry turbulence provides the necessary enhancement so that turbulators are not required in this part of the passage length.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a gas turbine bucket having a shank portion, a tip portion and an airfoil having leading and trailing edges and pressure and suction sides, and an internal fluid cooling circuit, the improvement comprising said internal fluid cooling circuit having a serpentine configuration including plural radial outflow passages and plural radial inflow passages, said radial outflow passages having a selected aspect ratio, and shaped to avoid an undesirable Buoyancy Number associated with the aspect ratio selected.

2. The gas turbine bucket of claim 1 wherein said radial inflow passages have, on average, larger cross-sectional areas than said radial outflow passages.

3. The gas turbine bucket of claim 1 wherein all of said radial inflow and outflow passages include internal, raised ribs for enhancing turbulent flow.

4. The gas turbine of claim 1 wherein said cooling circuit is a closed circuit, with all coolant entering and exiting the shank portion of the bucket.

5. In a gas turbine bucket having a shank portion, a tip portion and an airfoil extending between the shank portion and the tip portion, the airfoil having leading and trailing edges and pressure and suction sides, and an internal fluid cooling circuit, the improvement comprising said internal fluid cooling circuit having a serpentine configuration including plural radial outflow passages and plural radial inflow passages, said radial outflow passages having, on average, smaller cross-sectional areas than said radial inflow passages.

6. The gas turbine bucket of claim 5 wherein a ratio of the cross sectional area of the radial inflow passages to the cross sectional area of the radial outflow passages is about 1.5 to 1.

7. The gas turbine bucket of claim 5 wherein a radial inflow passage adjacent the leading edge of the bucket has a smaller cross sectional area than said radial outflow passages.

8. The gas turbine bucket of claim 5 wherein all of said radial inflow and outflow passages include internal, raised ribs for enhancing turbulent flow.

9. The gas turbine bucket of claim 5 and including a plurality of pins in at least one radial outflow passage, arranged substantially perpendicular to a direction of flow in said radial outflow passage.

10. The gas turbine bucket of claim 9 wherein said at least one radial outflow passage comprises a first radial outflow passage adjacent the trailing edge of the bucket.

11. The gas turbine bucket of claim 5 wherein said bucket includes a tip cap and wherein raised ribs are provided on an underside of the tip cap within said radial inflow and outflow passages.

12. The gas turbine of claim 5 wherein said bucket comprises a first or second stage bucket of a gas turbine.

13. In a gas turbine bucket having a shank portion, a radial tip portion and an airfoil having leading and trailing edges and pressure and suction sides, and a closed internal fluid cooling circuit, the improvement comprising said closed internal fluid cooling circuit having a serpentine configuration between a supply passage and an exit passage, said closed internal fluid cooling circuit including plural radial outflow passages and plural radial inflow passages, said radial outflow passages each having an aspect ratio at a bucket pitchline of from about 2 to 1 to about 3 to 1.

14. The gas turbine bucket of claim 13 wherein a ratio of the cross sectional area of the radial inflow passages to the cross sectional area of the radial outflow passages averages about 1.5 to 1.

15. The gas turbine bucket of claim 13 wherein a radial inflow passage adjacent the leading edge of the bucket has a smaller cross sectional area than said radial outflow passages.

16. The gas turbine bucket of claim 13 wherein all of said radial inflow and outflow passages include internal, raised ribs for enhancing turbulent flow.

17. The gas turbine bucket of claim 13 and including a plurality of pins in at least one radial outflow or inflow passage, arranged substantially perpendicular to a direction of flow in said radial outflow or inflow passage.

18. The gas turbine bucket of claim 17 wherein said at least one radial outflow or inflow passage comprises a passage adjacent the trailing edge of the bucket.

19. The gas turbine bucket of claim 15 wherein said bucket includes a tip cap and wherein raised ribs are provided on an underside of the tip cap within said radial inflow and outflow passages.

20. The gas turbine of claim 15 wherein said bucket comprises a first or second stage bucket of a gas turbine.

21. The gas turbine of claim 15 wherein said cooling circuit is a closed circuit, with all coolant entering and exiting the shank portion of the bucket.

22. A method of determining a configuration for radial outflow coolant passages for a bucket stage in a gas turbine comprising the steps of:

a) determining combustion gas inlet temperature and mass flow rate of combustion gases passing through the gas turbine stage;

b) taking into account Coriolis and buoyancy flow effects in the steam coolant caused by rotation of the bucket stage; and c) configuring the radial outflow coolant passages to have a size and shape to provide aspect ratios of about 3.3 to 1 and Buoyancy Numbers in said radial outflow passages of <0.15 or >0.80.

23. The method of claim 22 wherein steps a) through c) are carried out for a first or second stage bucket of said gas turbine.

24. The method of claim 22 wherein said gas turbine is a four stage gas turbine and wherein said first and second stages are steam cooled.

25. The method of claim 22 wherein the combustion gas inlet temperature is about 2400° F.

26. The method of claim 22 wherein the steam coolant temperature in the bucket stage is about 1000° F., at a pressure of about 700 psi.

27. The gas turbine bucket of claim 1 wherein the aspect ratio is about 3.3 to 1 and the Buoyancy Number is <0.15 or >0.80.

* * * * *

UNITED STATES PATENT AND TRADEMARK OFFICE

CERTIFICATE OF CORRECTION

PATENT NO. : 5,536,143
APPLICATION NO. : 08/414700
DATED : July 16, 1996
INVENTOR(S) : Jacala et al.

It is certified that error appears in the above-identified patent and that said Letters Patent is hereby corrected as shown below:

In Column 1, immediately below the title, insert:

--The Government of the United States of America has rights in this invention pursuant to Contract No. DE-FC21-95MC31176 awarded by the U. S. Department of Energy.--

Signed and Sealed this

Twentieth Day of February, 2007

JON W. DUDAS
*Director of the United States Patent and Trademark Office*